US009858867B2

(12) United States Patent
Baik

(10) Patent No.: US 9,858,867 B2
(45) Date of Patent: Jan. 2, 2018

(54) METHOD OF CONTROLLING SCALE FACTOR AND METHOD OF CONTROLLING LUMINANCE INCLUDING THE SAME

(71) Applicant: SAMSUNG DISPLAY CO., LTD., Yongin, Gyeonggi-Do (KR)

(72) Inventor: Joon-Suk Baik, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 93 days.

(21) Appl. No.: 14/706,397

(22) Filed: May 7, 2015

(65) Prior Publication Data

US 2016/0155388 A1 Jun. 2, 2016

(30) Foreign Application Priority Data

Dec. 2, 2014 (KR) ..... 10-2014-0170233

(51) Int. Cl.

| | |
|---|---|
| ***G09G 3/34*** | (2006.01) |
| ***G09G 3/20*** | (2006.01) |
| ***G09G 5/10*** | (2006.01) |

(52) U.S. Cl.

CPC ..... *G09G 3/3406* (2013.01); *G09G 3/20* (2013.01); *G09G 5/10* (2013.01); *G09G 2320/0247* (2013.01); *G09G 2320/0271* (2013.01); *G09G 2320/0626* (2013.01); *G09G 2320/0646* (2013.01); *G09G 2320/0653* (2013.01); *G09G 2320/103* (2013.01); *G09G 2330/021* (2013.01); *G09G 2330/023* (2013.01); *G09G 2340/16* (2013.01); *G09G 2360/16* (2013.01)

(58) Field of Classification Search

CPC ..... G09G 3/3406; G09G 3/20; G09G 5/10; G09G 2320/0247; G09G 2320/0271; G09G 2320/0626; G09G 2320/0646; G09G 2320/0653; G09G 2320/103; G09G 2330/021; G09G 2330/023; G09G 2340/16

See application file for complete search history.

(56) References Cited

U.S. PATENT DOCUMENTS

| | | | | |
|---|---|---|---|---|
| 2006/0238485 | A1 | 10/2006 | Yang | |
| 2007/0029940 | A1* | 2/2007 | Tsuge | G09G 3/3241 315/169.3 |
| 2007/0182757 | A1 | 8/2007 | Sankar et al. | |
| 2008/0252628 | A1* | 10/2008 | Han | G09G 5/10 345/207 |
| 2009/0243986 | A1 | 10/2009 | Jung | |

(Continued)

FOREIGN PATENT DOCUMENTS

| | | | |
|---|---|---|---|
| KR | 10-2005-0068169 | A | 7/2005 |
| KR | 10-2007-0030019 | A | 3/2007 |
| KR | 10-2014-0048691 | A | 4/2014 |

OTHER PUBLICATIONS

European Search Report dated Apr. 28, 2016 in Corresponding European Patent Application No. 15176809.0.

*Primary Examiner* — Sahlu Okebato
(74) *Attorney, Agent, or Firm* — Lee & Morse, P.C.

(57) ABSTRACT

A method for controlling a scale factor includes generating a load value corresponding to accumulated input data, providing a target scale factor corresponding to the load value, and providing a scale factor based on the target scale factor, a limit scale factor, and a moving step. The limit scale factor and the moving step are determined based on power consumption of a display panel.

19 Claims, 11 Drawing Sheets

(56) References Cited

U.S. PATENT DOCUMENTS

| | | | | |
|---|---|---|---|---|
| 2009/0251399 | A1 | 10/2009 | Kim | |
| 2010/0053222 | A1* | 3/2010 | Kerofsky ..... | G09G 3/3406 345/690 |
| 2012/0256936 | A1 | 10/2012 | Lee et al. | |
| 2012/0299977 | A1 | 11/2012 | Chen et al. | |
| 2013/0016141 | A1 | 1/2013 | Chang et al. | |
| 2014/0204131 | A1 | 7/2014 | Chen et al. | |

* cited by examiner

METHOD OF CONTROLLING SCALE FACTOR AND METHOD OF CONTROLLING LUMINANCE INCLUDING THE SAME

CROSS REFERENCE TO RELATED APPLICATION

Korean Patent Application No. 10-2014-0170233, filed on Dec. 2, 2014, and entitled, "Method of Controlling Scale Factor and Method of Controlling Luminance Including the Same," is incorporated by reference herein in its entirety.

BACKGROUND

1. Field

One or more embodiments described herein relate to a method for controlling scale factor and a method for controlling luminance.

2. Description of the Related Art

The development of electronic devices with higher levels of performance and lower power consumption continues to be a focus of system designers.

SUMMARY

In accordance with one or more embodiments, a method for controlling a scale factor comprising generating a load value corresponding to accumulated input data; providing a target scale factor corresponding to the load value; and providing a scale factor based on the target scale factor, a limit scale factor, and a moving step, wherein the limit scale factor and the moving step are determined based on power consumption of a display panel. The method may include, when the target scale factor is less than a previous scale factor provided before the target scale factor, comparing the limit scale factor corresponding to the target scale factor to the previous scale factor.

The method may include, when the previous scale factor is greater than the limit scale factor corresponding to the target scale factor, providing the limit scale factor corresponding to the target scale factor as the scale factor. The method may include providing the scale factor in each of a plurality of frames. The method may include, when the limit scale factor corresponding to the target scale factor is provided as a first scale factor in a first frame, providing a second scale factor in a second frame, the second scale factor is less than the limit scale factor corresponding to the target scale factor by the moving step.

The method may include, when the second scale factor is provided in the second frame, providing a third scale factor in a third frame after the second frame, wherein the third scale factor is less than the second scale factor by the moving step. The method may include, decreasing the scale factor until a difference between the scale factor and the target scale factor is less than the moving step. The luminance of a displayed image may be based on the scale factor.

The method may include, when the target scale factor is less than a previous scale factor provided before the target scale factor, providing the target scale factor as the scale factor. The method may include controlling the moving step based on a step control signal. The method may include controlling the limit scale factor based on a scale control signal. The method may include, when the previous scale factor is less than the limit scale factor corresponding to the target scale factor, providing the previous scale factor as the scale factor.

The method may include, when the previous scale factor is less than the limit scale factor corresponding to the target scale factor, providing the scale factor that is less than the previous scale factor by the moving step. The method may include providing the scale factor in each of a plurality of frames. The method may include, when a first scale factor less than the previous scale factor by the moving step is provided in a first frame, providing a second scale factor less than the first scale factor by the moving step in a second frame.

The method may include decreasing the scale factor until a difference between the scale factor and the target scale factor is less than the moving step. The method may include, when the previous scale factor is equal to the limit scale factor corresponding to the target scale factor, providing the limit scale factor corresponding to the target scale factor as the scale factor. The method may include, when the target scale factor is greater than a previous scale factor provided before the target scale factor, providing the target scale factor as the scale factor.

In accordance with one or more other embodiments, a method for controlling luminance includes generating a load value corresponding to an accumulated input data; providing a target scale factor corresponding to the load value; providing a scale factor based on the target scale factor, a limit scale factor, and a moving step, the limit scale factor and the moving step determined based on power consumption of a display panel; and providing display data based on the input data and the scale factor. The method may include, when the target scale factor is less than a previous scale factor provided before the target scale factor and the previous scale factor is greater than the limit scale factor, providing the limit scale factor corresponding to the target scale factor as the scale factor.

In accordance with one or more other embodiments, an apparatus for controlling a scale factor comprising: a data accumulator to generate a load value corresponding to an accumulation input data; a scale factor generator to provide a target scale factor corresponding to the load value; and a time filter to provide a scale factor based on the target scale factor, a limit scale factor, and a moving step, wherein the limit scale factor and the moving step are to be determined based on power consumption of a display panel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
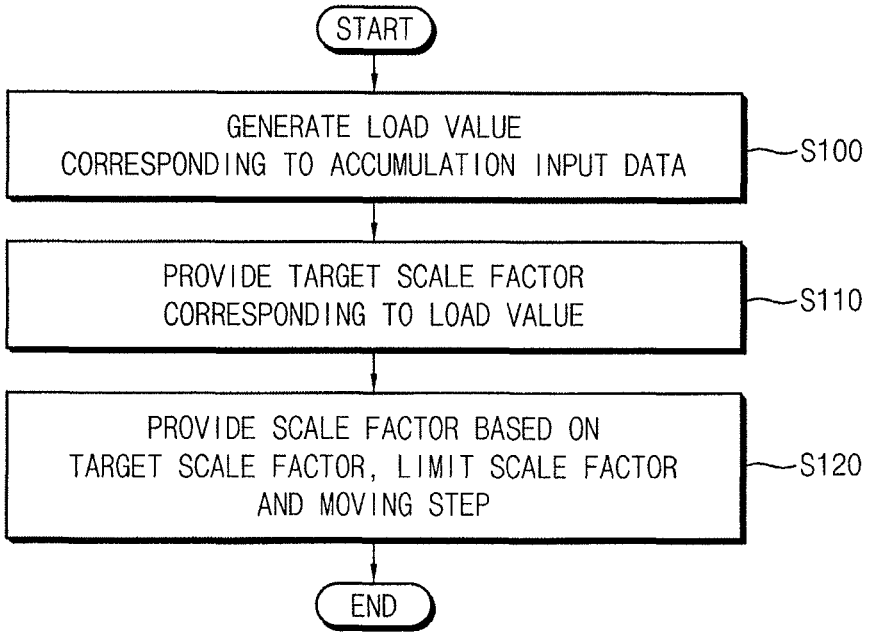
FIG. 1 illustrates an embodiment of a method for controlling a scale factor.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

Figure 2:
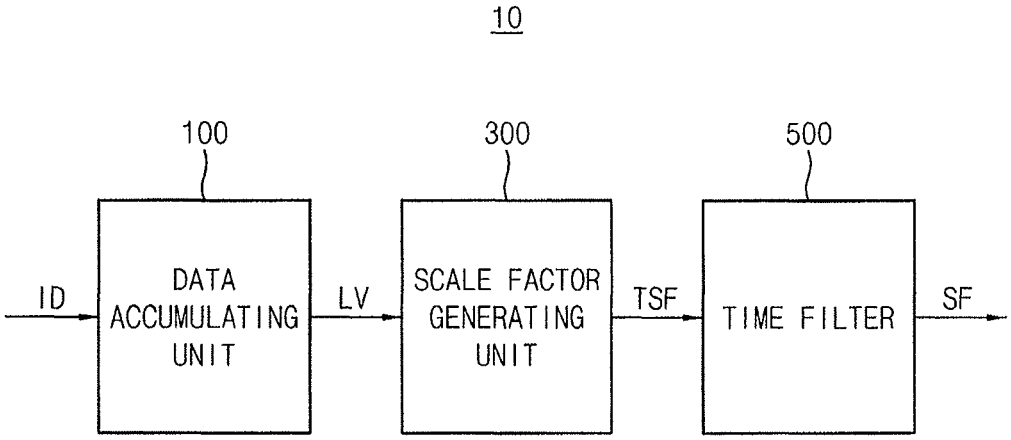
FIG. 2 illustrates an embodiment of a scale factor controller.

FIG. 1 illustrates an embodiment of a method for controlling a scale factor, and FIG. 2 illustrates an embodiment of a scale factor controller 10 which may be used to perform the method.

Referring to FIGS. 1 and 2, the scale factor controller 10 includes a data accumulating unit 100, a scale factor generating unit 300, and a time filter 500. In performing the method, the data accumulating unit 100 generates a load value LV corresponding to an accumulation input data by accumulating an input data ID (S100). The accumulation input data may be a sum of the input data ID in the one frame. The load value LV may be an average value of the accumulation input data. For example, the number of input data ID in the one frame may be 100 and the accumulation input data corresponding to the sum of the input data ID may be 1000. In this case, the load value LV may be 10. The load value LV may be determined, for example, by dividing 1000 by 100.

The scale factor generating unit 300 provides a target scale factor TSF corresponding to the load value LV (S110). When the load value LV is increased, power consumption of the display panel may decrease by multiplying the input data ID and the scale factor SF. For example, the number of input data ID in the one frame may be 100. The accumulation input data, that is the sum of the input data ID, may be increased from 1000 to 3000. In this case, the load value LV may be increased from 10 to 30. When the load value LV is increased from 10 to 30, power consumption of the display panel may increase. However, power consumption of the display panel may decrease using the scale factor SF.

A time filter 500 provides a scale factor SF based on the target scale factor TSF, a limit scale factor LSF, and a moving step MS (S120). The limit scale factor LSF and the moving step MS are determined by power consumption of a display panel. The limit power consumption of the display panel may be predetermined. The limit scale factor LSF may be determined in the range of the limit power consumption of the display device. The scale factor SF for the previous frame FP may be a previous scale factor PSF. The scale factor SF to be finally reached may be the target scale factor TSF.

The time filter 500 may gradually provide the scale factor SF from the previous scale factor PSF to the target scale factor TSF. As described in FIG. 5, for example, the target scale factor TSF may be a fourth scale factor SF4. In this case, the time filter 500 may gradually increase the scale factor SF every frame. The time filter 500 may provide a first scale factor SF1 in a first frame F1. The time filter 500 may provide a second scale factor SF2 in a second frame F2. The time filter 500 may provide a third scale factor SF3 in a third frame F3. The time filter 500 may provide a fourth scale factor SF4 in a fourth frame F4. When the time filter 500 gradually provides the scale factor SF from the previous scale factor PSF to the target scale factor TSF, the image may be naturally displayed in the display panel.

The moving step MS may, for example, be an interval between the first scale factor SF1 and the second scale factor SF2. The moving step MS may be an interval between the second scale factor SF2 and the third scale factor SF3. The moving step MS may be an interval between the third scale factor SF3 and the fourth scale factor SF4. In addition, the interval between the first scale factor SF1 and the second scale factor SF2 may be equal to the interval between the second scale factor SF2 and the third scale factor SF3. The interval between the second scale factor SF2 and the third scale factor SF3 may be equal to the interval between the third scale factor SF3 and the fourth scale factor SF4. The moving step MS may be predetermined before the time filter 500 is operated.

The method for controlling scale factor may decrease power consumption when the scale factor SF is based on the limit scale factor LSF and the moving step MS that are determined by the power consumption of the display panel.

Figure 3:
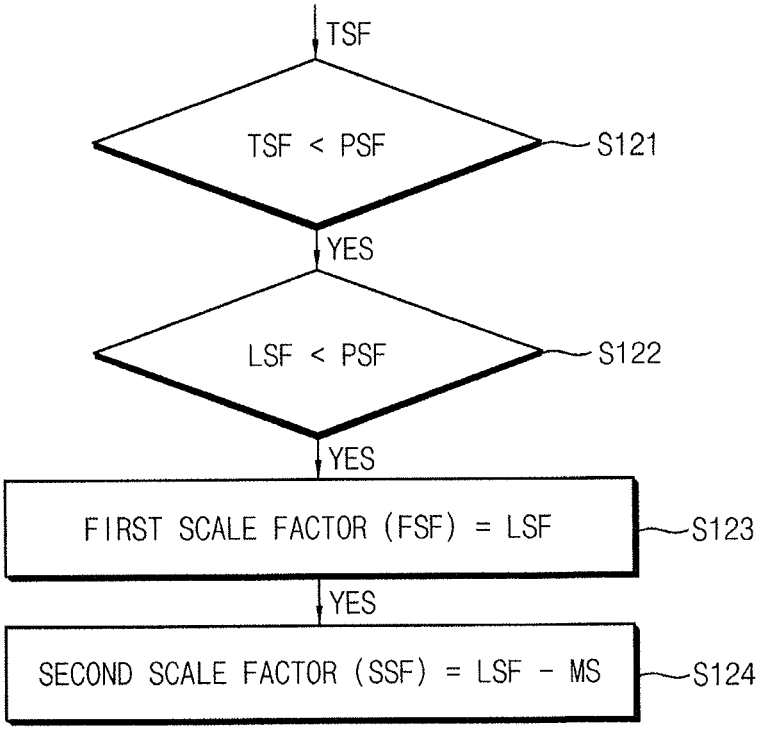
FIG. 3 illustrates an embodiment of a method for controlling scale factor when a limit scale factor is less than a previous scale factor.
Figure 4:
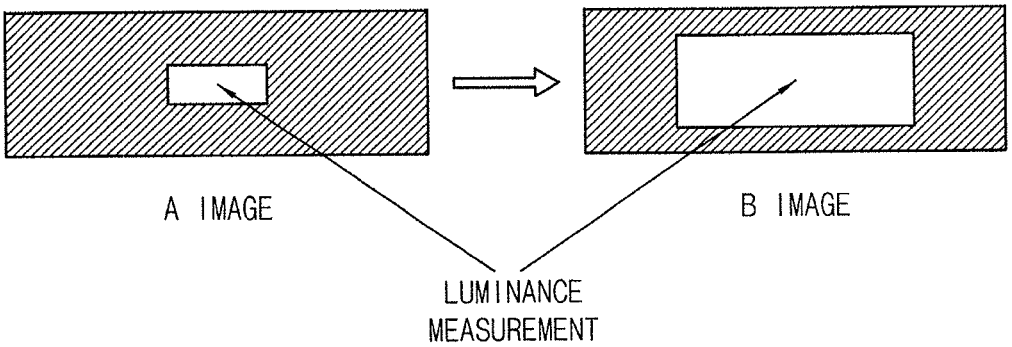
FIGS. 4 to 6 illustrate examples relating to the method of FIG. 3.
Figure 5:
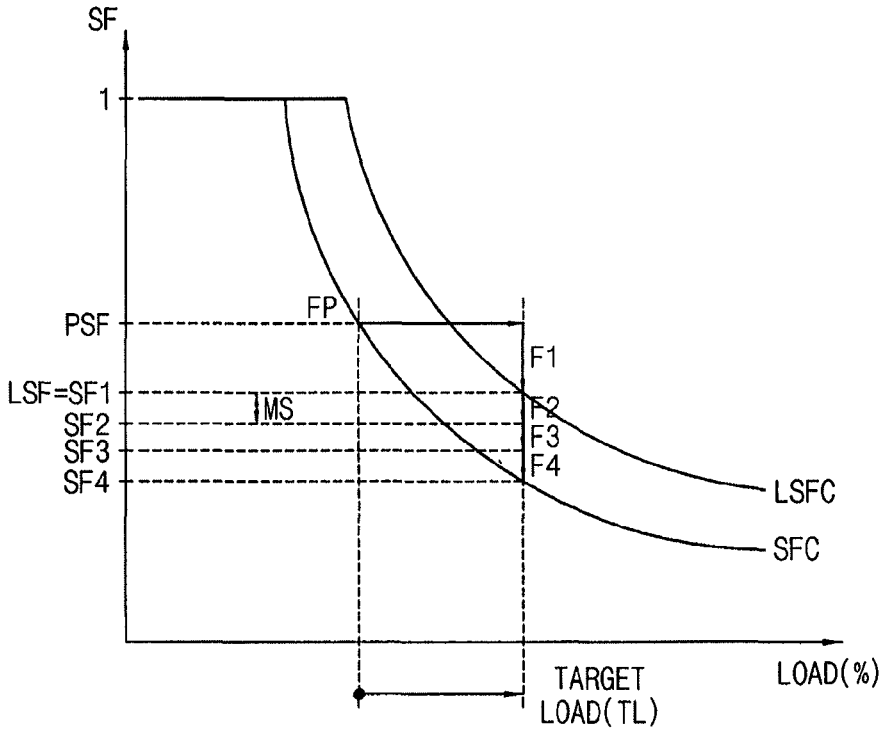
Figure 6:
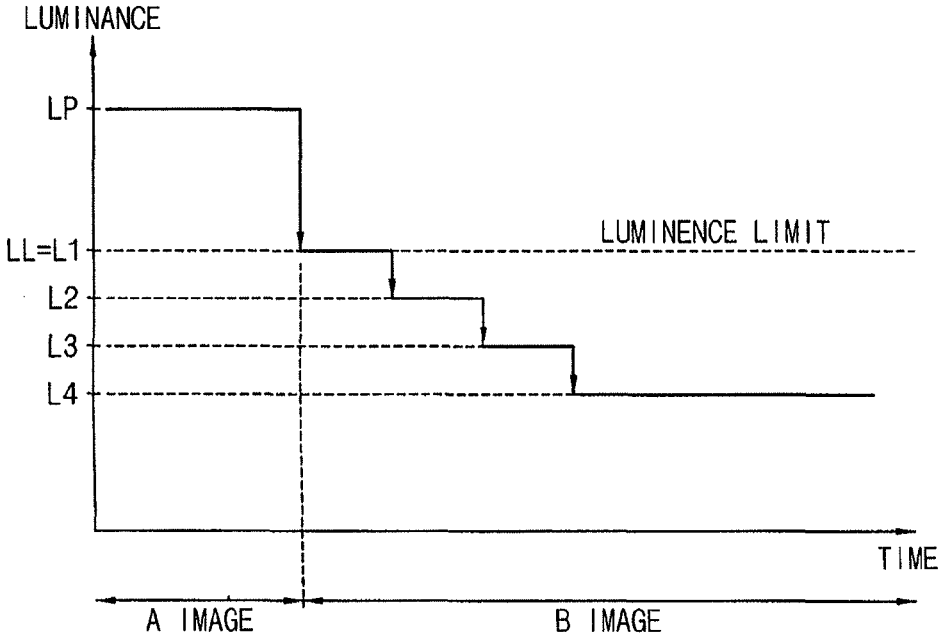

FIG. 3 illustrates an embodiment of a method for controlling the scale factor in FIG. 1, in the case where the limit scale factor is less than a previous scale factor. FIGS. 4 to 6 illustrate examples corresponding to the method of FIG. 3.

Referring to FIGS. 3 to 6, when the target scale factor TSF is less than a previous scale factor PSF provided before the target scale factor TSF, the limit scale factor LSF corresponding to the target scale factor TSF may be compared to the previous scale factor PSF. The previous scale factor PSF may be provided from the scale factor generating unit 300 or the time filter 500. For example, the number of the input data ID in one frame may be 100. The accumulation input data in A-image may be 1000. The accumulation input data in B-image may be 3000. When the display panel displays the B-image after displaying the A-image, the accumulation input data may be increased from 1000 to 3000. In this case, the target scale factor TSF may be less than a previous scale factor PSF provided before the target scale factor TSF. When the target scale factor TSF is less than a previous scale factor PSF provided before the target scale factor TSF, the limit scale factor LSF corresponding to the target scale factor TSF may be compared to the previous scale factor PSF.

In an example embodiment, when the previous scale factor PSF is greater than the limit scale factor LSF corresponding to the target scale factor TSF, the time filter 500 may provide the limit scale factor LSF corresponding to the target scale factor TSF as the scale factor SF. For example, the limit scale factor LSF corresponding to the target scale factor TSF may be a first scale factor SF1. The previous scale factor PSF may be greater than the first scale factor SF1. In this case, the time filter 500 may provide the first scale factor SF1 as the scale factor SF.

The limit scale factor LSF may be determined by the power consumption of the display panel. In a scale factor curve SFC corresponding to the target scale factor TSF, the scale factor SF may be decreased as the load is increased. In a limit scale factor curve LSFC, the scale factor SF may be decreased as the load is increased. For the same target load TL, the limit scale factor LSF on the limit scale factor curve LSFC may be greater than the scale factor SF on the scale factor curve SFC. The limit scale factor LSF may be a greatest scale factor SF for the target load TL in the range of the limit power consumption of the display panel.

For example, the scale factor SF on the scale factor curve SFC corresponding to the target load TL may be a fourth scale factor SF4. In this case, the fourth scale factor SF4 may be the target scale factor TSF. The limit scale factor LSF on the limit scale factor curve LSFC corresponding to the target load TL may be a first scale factor SF1. The first scale factor SF1 may be greater than the fourth scale factor SF4. The method for controlling scale factor may decrease the power consumption by providing the scale factor SF based on the limit scale factor LSF and the moving step MS that are determined by the power consumption of the display panel.

In an example embodiment, the time filter 500 may provide the scale factor SF every frame. For example, the time filter 500 may provide a first scale factor SF1 in a first frame F1. The time filter 500 may provide a second scale factor SF2 in a second frame F2. The time filter 500 may provide a third scale factor SF3 in a third frame F3. The time filter 500 may provide a fourth scale factor SF4 in a fourth frame F4.

In an example embodiment, when the time filter 500 provides the limit scale factor LSF corresponding to the target scale factor TSF as a first scale factor SF1 in a first frame F1, the time filter 500 may provide a second scale factor SF2 in a second frame F2. The second scale factor SF2 may be less than the limit scale factor LSF corresponding to the target scale factor TSF by the moving step MS. For example, the target scale factor TSF corresponding to the target load TL may be the fourth scale factor SF4. When the target scale factor TSF is the fourth scale factor SF4, the limit scale factor LSF corresponding to the target scale factor TSF may be the first scale factor SF1. When the time filter 500 provides the limit scale factor LSF corresponding to the target scale factor TSF as a first scale factor SF1 in a first frame F1, the time filter 500 may provide a second scale factor SF2 in a second frame F2.

The second scale factor SF2 may be less than the limit scale factor LSF corresponding to the target scale factor TSF by the moving step MS. For example, when the time filter 500 provides the second scale factor SF2 in the second frame F2, the time filter 500 may provide a third scale factor SF3 in a third frame F3 after the second frame F2. The third scale factor SF3 may be less than the second scale factor SF2 by the moving step MS. For example, the moving step MS may be an interval between the first scale factor SF1 and the second scale factor SF2. The moving step MS may be an interval between the second scale factor SF2 and the third scale factor SF3. The moving step MS may be an interval between the third scale factor SF3 and the fourth scale factor SF4.

In addition, the interval between the first scale factor SF1 and the second scale factor SF2 may be equal to the interval between the second scale factor SF2 and the third scale factor SF3. The interval between the second scale factor SF2 and the third scale factor SF3 may be equal to the interval between the third scale factor SF3 and the fourth scale factor SF4. The moving step MS may be predetermined before the time filter 500 is operated.

In an example embodiment, the time filter 500 may decrease the scale factor SF until a difference between the scale factor SF and the target scale factor TSF is less than the moving step MS. For example, when the time filter 500 decreases the scale factor SF at interval of the moving step MS, the scale factor SF provided from the time filter 500 may not coincide with the target scale factor TSF. In this case, the time filter 500 may decrease the scale factor SF until a difference between the scale factor SF and the target scale factor TSF is less than the moving step MS.

In an example embodiment, the luminance of an image displayed in the display panel may be determined by the scale factor SF provided by the time filter 500. For example, when the display panel displays the B-image after displaying the A-image, the time filter 500 may provide the limit scale factor LSF corresponding to the target scale factor TSF as a first scale factor SF1 in a first frame F1. When the time filter 500 provides the limit scale factor LSF corresponding to the target scale factor TSF as a first scale factor SF1 in a first frame F1, the luminance of an image displayed in the display panel may be a first luminance L1. The first luminance L1 may be a greatest luminance for the target load TL in range of the limit power consumption of the display panel.

The second scale factor SF2 may be less than the limit scale factor LSF corresponding to the target scale factor TSF by moving step MS. When the time filter 500 provides a second scale factor SF2 in a second frame F2, the luminance of an image that is displayed in the display panel may be a second luminance L2.

The third scale factor SF3 may be less than the second scale factor SF2 by the moving step MS. When the time filter 500 provides a third scale factor SF3 in a third frame F3 after the second frame F2, the luminance of an image that is displayed in the display panel may be a third luminance L3.

The fourth scale factor SF4 may be less than the third scale factor SF3 by the moving step MS. When the time filter 500 provides a fourth scale factor SF4 in a fourth frame F4 after the third frame F3, the luminance of an image that is displayed in the display panel may be a fourth luminance L4.

The method for controlling scale factor may decrease the power consumption by providing the scale factor SF based on the limit scale factor LSF and the moving step MS that are determined by the power consumption of the display panel.

Figure 7:
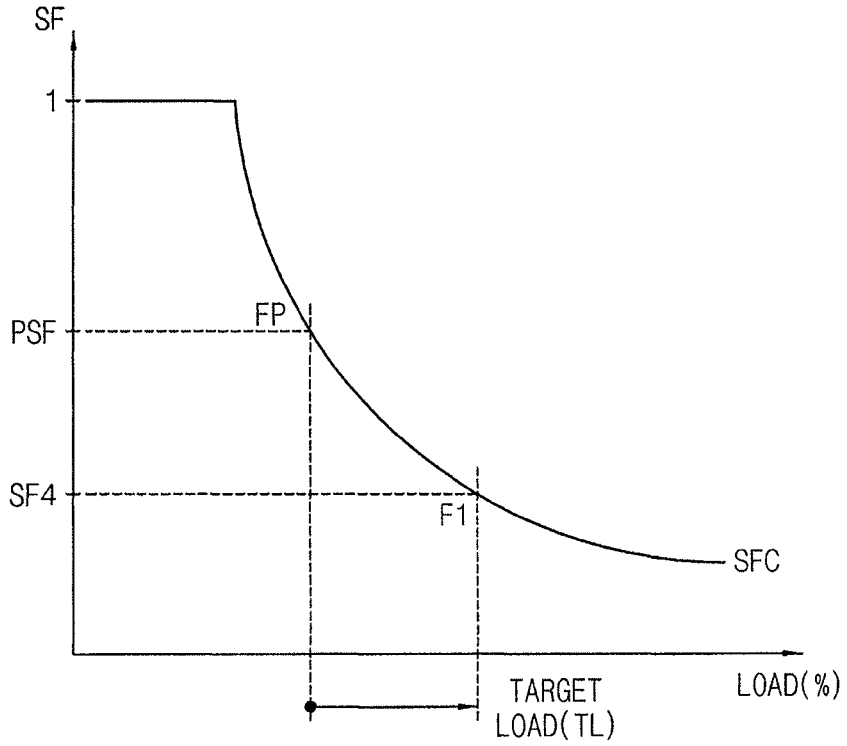
FIGS. 7 and 8 illustrate other examples relating to the method of FIG. 3.
Figure 8:
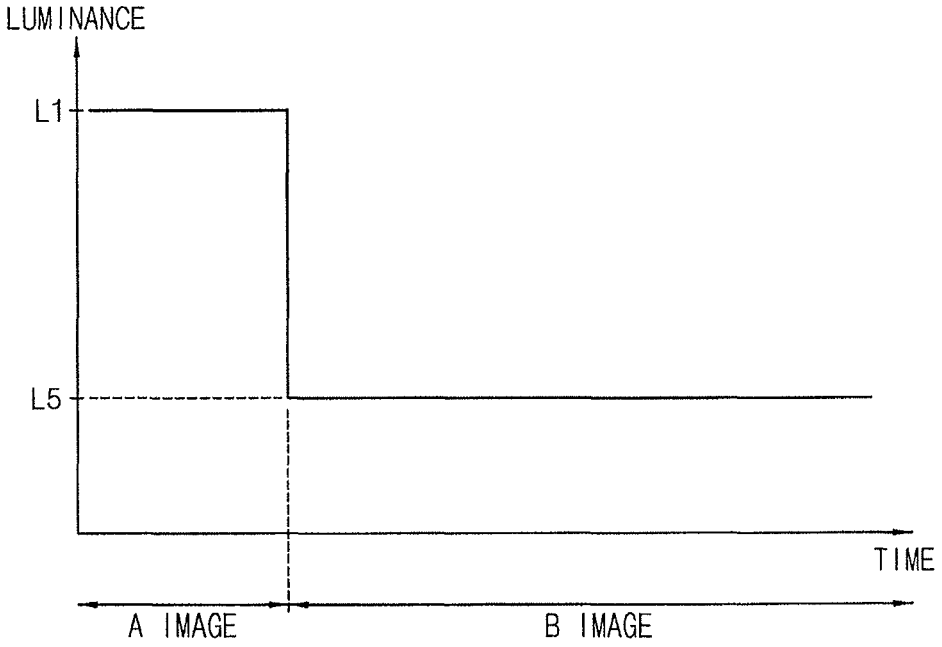

FIGS. 7 and 8 illustrate other examples relating to the method for controlling the scale factor of FIG. 1, when a limit scale factor is less than a previous scale factor. Referring to FIGS. 7 and 8, when the target scale factor TSF is less than a previous scale factor PSF provided before the target scale factor TSF, the time filter 500 may provide the target scale factor TSF as the scale factor SF. The scale factor SF for the previous frame FP may be a previous scale factor PSF. The scale factor SF to be finally reached may be the target scale factor TSF. For example, the scale factor SF on the scale factor curve SFC corresponding to the target load TL may be a fourth scale factor SF4. In this case, the fourth scale factor SF4 may be the target scale factor TSF. In this case, the time filter 500 may provide the target scale factor TSF as the scale factor SF in the first frame F1 that is provided after the previous frame FP.

Figure 9:
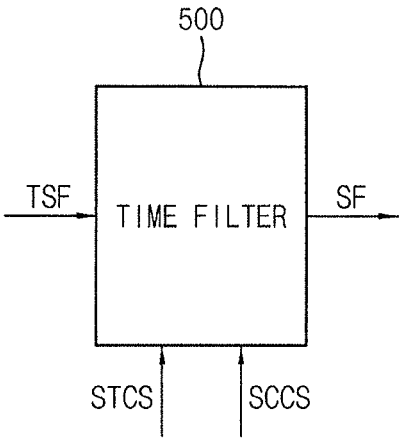
FIG. 9 illustrates an embodiment of a time filter.

FIG. 9 illustrates an embodiment of the time filter 500 in the scale factor controller of FIG. 2. Referring to FIG. 9, a time filter 500 provides a scale factor SF based on the target scale factor TSF, a limit scale factor LSF, and a moving step MS. The limit scale factor LSF and the moving step MS may be determined by power consumption of a display panel. The moving step MS may be controlled based on a step control signal STCS. For example, the moving step MS may be increased as a value of the step control signal STCS is increased. When the moving step MS is increased, the interval between the first scale factor SF1 and the second scale factor SF2 may be increased. When the interval between the first scale factor SF1 and the second scale factor SF2 is increased, the interval between the first luminance L1 and the second luminance L2 may be increased.

In addition, the moving step MS may be decreased as a value of the step control signal STCS is decreased. When the moving step MS is decreased, the interval between the first scale factor SF1 and the second scale factor SF2 may be decreased. When the interval between the first scale factor SF1 and the second scale factor SF2 is decreased, the interval between the first luminance L1 and the second luminance L2 may be decreased.

In an example embodiment, the limit scale factor LSF may be controlled based on a scale control signal SCCS. For example, the limit scale factor LSF may be increased as a value of the scale control signal SCCS is increased. In addition, the limit scale factor LSF may be decreased as a value of the scale control signal SCCS is decreased.

Figure 10:
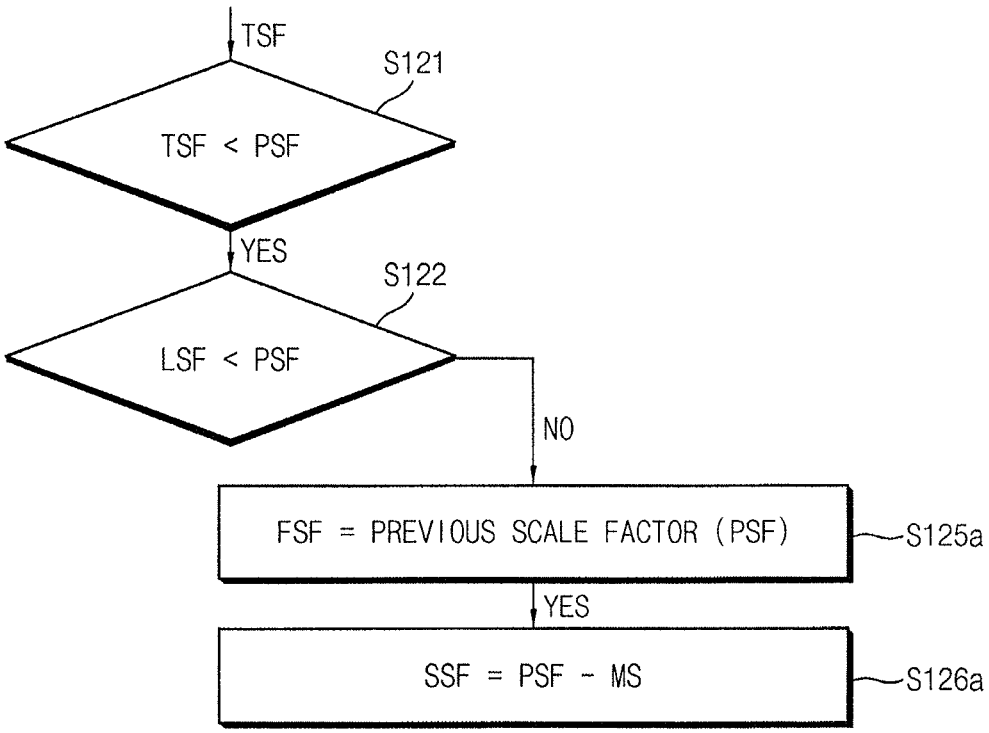
FIG. 10 illustrates an embodiment of a method for controlling scale factor when a limit scale factor is greater than a previous scale factor.

FIG. 10 illustrates another embodiment of a method for controlling scale factor in FIG. 1, when the limit scale factor is greater than a previous scale factor. Referring to FIG. 10, when the target scale factor TSF is less than a previous scale factor PSF provided before the target scale factor TSF, the limit scale factor LSF corresponding to the target scale factor TSF may be compared to the previous scale factor PSF. In an example embodiment, when the previous scale factor PSF is less than the limit scale factor LSF corresponding to the target scale factor TSF, the time filter 500 may provide the previous scale factor PSF as the scale factor SF. In this case, the time filter 500 may provide the previous scale factor PSF as the scale factor SF in the first frame F1 provided after the previous frame FP.

When the time filter 500 provides the previous scale factor PSF as the scale factor SF in the first frame F1 provided after the previous frame FP, the time filter 500 may provide the scale factor SF that is less than the previous scale factor PSF by the moving step MS in the second frame. In the same manner, the time filter 500 may decrease the scale factor SF until a difference between the scale factor SF and the target scale factor TSF is less than the moving step MS.

The method of controlling scale factor may decrease the power consumption by providing the scale factor SF based on the limit scale factor LSF and the moving step MS that are determined by the power consumption of the display panel.

Figure 11:
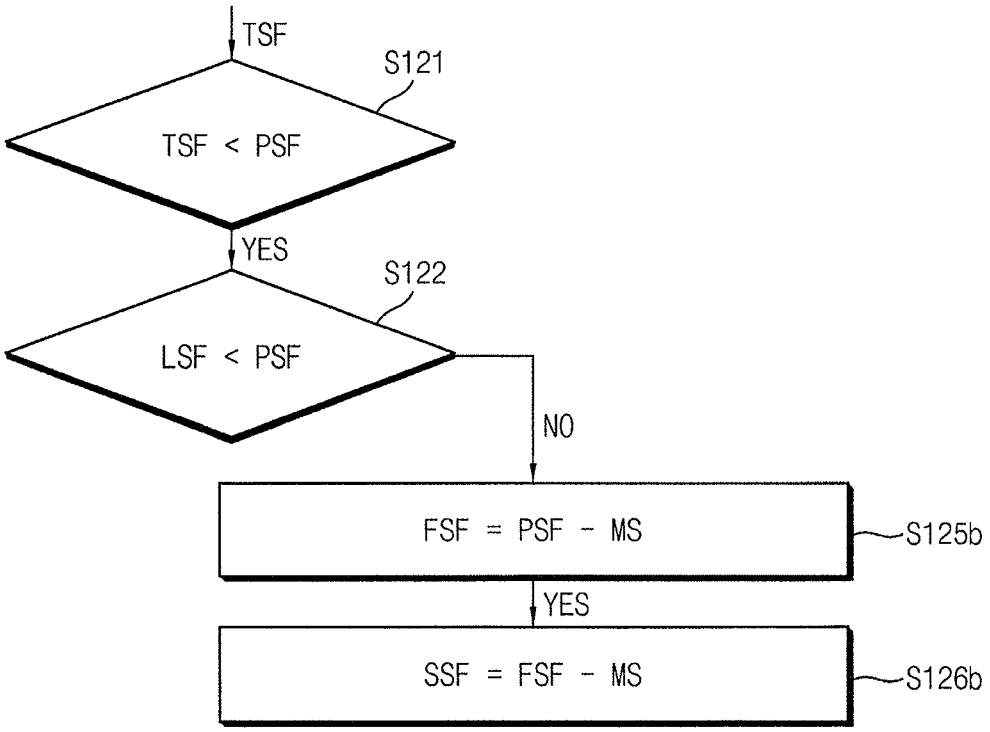
FIG. 11 illustrates another embodiment of a method for controlling scale factor when a limit scale factor is greater than a previous scale factor.
Figure 12:
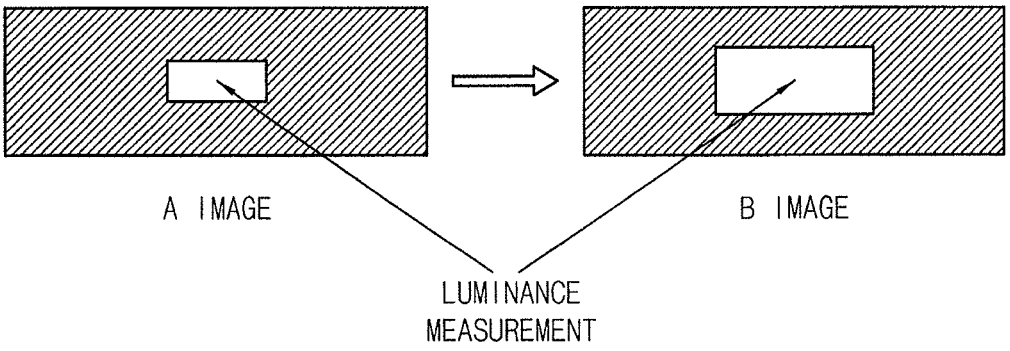
FIGS. 12 to 14 illustrate examples relating to the method of FIG. 11.
Figure 13:
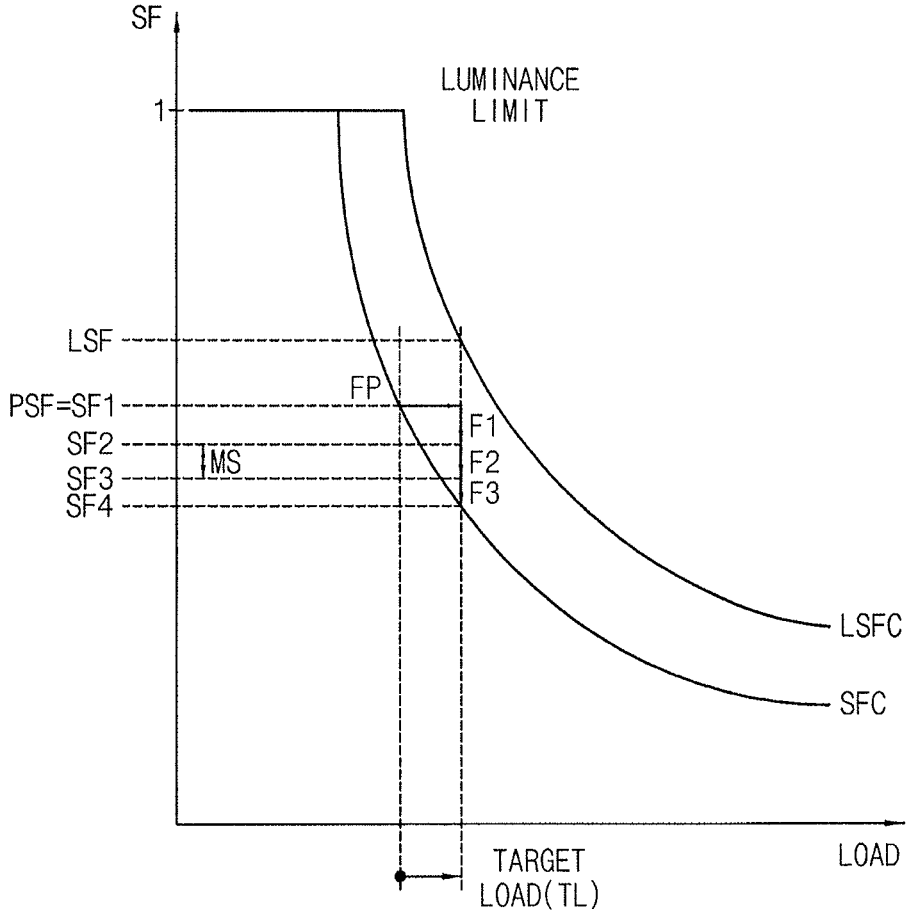
Figure 14:
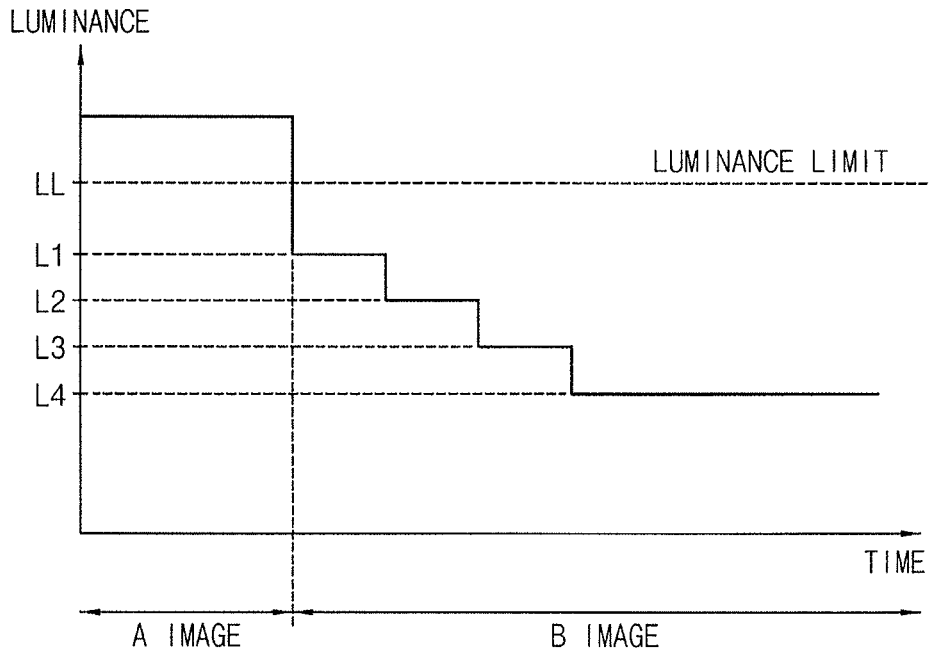

FIG. 11 illustrates another embodiment of a method for controlling the scale factor in FIG. 1, when the limit scale factor is greater than a previous scale factor. FIGS. 12 to 14 illustrate examples relating to the method of FIG. 11.

Referring to FIGS. 11 to 14, when the target scale factor TSF is less than a previous scale factor PSF provided before the target scale factor TSF, the limit scale factor LSF corresponding to the target scale factor TSF may be compared to the previous scale factor PSF. For example, the number of the input data ID in one frame may be 100. The accumulation input data in A-image may be 1000. The accumulation input data in B-image may be 2500. When the display panel displays the B-image after displaying the A-image, the accumulation input data may be increased from 1000 to 2500. In this case, the target scale factor TSF may be less than a previous scale factor PSF provided before the target scale factor TSF. When the target scale factor TSF is less than a previous scale factor PSF provided before the target scale factor TSF, the limit scale factor LSF corresponding to the target scale factor TSF may be compared to the previous scale factor PSF.

In an example embodiment, when the previous scale factor PSF is less than the limit scale factor LSF corresponding to the target scale factor TSF, the time filter 500 may provide the scale factor SF that is less than the previous scale factor PSF by the moving step MS. For example, the previous scale factor PSF may be a first scale factor SF1. The limit scale factor LSF corresponding to the target scale factor TSF may be greater than the first scale factor SF1. In this case, the time filter 500 may provide the scale factor SF that is less than the first scale factor SF1 by the moving step MS.

The limit scale factor LSF may be determined by power consumption of the display panel. In a scale factor curve SFC corresponding to the target scale factor TSF, the scale factor SF may be decreased as the load is increased. In a limit scale factor curve LSFC, the scale factor SF may be decreased as the load is increased. For the same target load TL, the limit scale factor LSF on the limit scale factor curve LSFC may be greater than the scale factor SF on the scale factor curve SFC.

The limit scale factor LSF may be a greatest scale factor SF for the target load TL in the range of the limit power consumption of the display panel. For example, the scale factor SF on the scale factor curve SFC corresponding to the target load TL may be a fourth scale factor SF4. In this case, the fourth scale factor SF4 may be a target scale factor TSF. The limit scale factor LSF may be greater than the fourth scale factor SF4. The method for controlling scale factor may decrease power consumption by providing the scale factor SF based on the limit scale factor LSF and the moving step MS that are determined by the power consumption of the display panel.

In an example embodiment, the time filter 500 may provide the scale factor SF every frame. For example, the time filter 500 may provide a second scale factor SF2 in a first frame F1. The second scale factor SF2 may be less than the first scale factor SF1 by the moving step MS. The time filter 500 may provide a third scale factor SF3 in a second frame F2. The third scale factor SF3 may be less than the second scale factor SF2 by the moving step MS. The time filter 500 may provide a fourth scale factor SF4 in a third frame F3. The fourth scale factor SF4 may be less than the third scale factor SF3 by the moving step MS.

In an example embodiment, when the time filter 500 provides a first scale factor SF1 that is less than the previous scale factor PSF by the moving step MS in a first frame F1, the time filter 500 may provide a second scale factor SF2 that is less than the first scale factor SF1 by the moving step MS in a second frame F2. For example, the target scale factor TSF corresponding to the target load TL may be the fourth scale factor SF4. When the time filter 500 provides the second scale factor SF2 that is less than the first scale factor SF1 by the moving step MS in the first frame F1, the time filter 500 may provide the third scale factor SF3 that is less than the second scale factor SF2 by the moving step MS in second frame F2.

In addition, when the time filter 500 provides the third scale factor SF3 that is less than the second scale factor SF2 by the moving step MS in the second frame F2, the time filter 500 may provide the fourth scale factor SF4 that is less than the third scale factor SF3 by the moving step MS in the third frame F3. For example, the moving step MS may be an interval between the first scale factor SF1 and the second scale factor SF2. The moving step MS may be an interval between the second scale factor SF2 and the third scale factor SF3. The moving step MS may be an interval between the third scale factor SF3 and the fourth scale factor SF4. In addition, the interval between the first scale factor SF1 and the second scale factor SF2 may be equal to the interval between the second scale factor SF2 and the third scale factor SF3. The interval between the second scale factor SF2 and the third scale factor SF3 may be equal to the interval between the third scale factor SF3 and the fourth scale factor SF4. The moving step MS may be predetermined before the time filter 500 is operated.

In an example embodiment, the time filter 500 may decrease the scale factor SF until a difference between the scale factor SF and the target scale factor TSF is less than the moving step MS. For example, in case the time filter 500 decreases the scale factor SF at interval of the moving step MS, the scale factor SF provided from the time filter 500 may not coincide with the target scale factor TSF. In this case, the time filter 500 may decrease the scale factor SF until a difference between the scale factor SF and the target scale factor TSF is less than the moving step MS.

In an example embodiment, in case the previous scale factor PSF is equal to the limit scale factor LSF corresponding to the target scale factor TSF, the time filter 500 may provide the limit scale factor LSF corresponding to the target scale factor TSF as the scale factor SF. For example, in case the limit scale factor LSF is the first scale factor SF1 and the previous scale factor PSF is the first scale factor SF1, the time filter 500 may provide the first scale factor SF1 as the scale factor.

In an example embodiment, the luminance of an image displayed in the display panel may be determined by the scale factor SF provided by the time filter 500. For example, when the display panel displays the B-image after displaying the A-image, the time filter 500 may provide the second scale factor SF2 in a first frame F1. When the time filter 500 provides the second scale factor SF2 in a first frame F1, the luminance of an image displayed in the display panel may be a second luminance L2. When the time filter 500 provides the third scale factor SF3 in a second frame F2, the luminance of an image that is displayed in the display panel may be a third luminance L3. When the time filter 500 provides the fourth scale factor SF4 in a third frame F3, the luminance of an image that is displayed in the display panel may be a fourth luminance L4.

The method of controlling scale factor may decrease power consumption by providing the scale factor SF based on the limit scale factor LSF and the moving step MS that are determined by the power consumption of the display panel.

Figure 15:
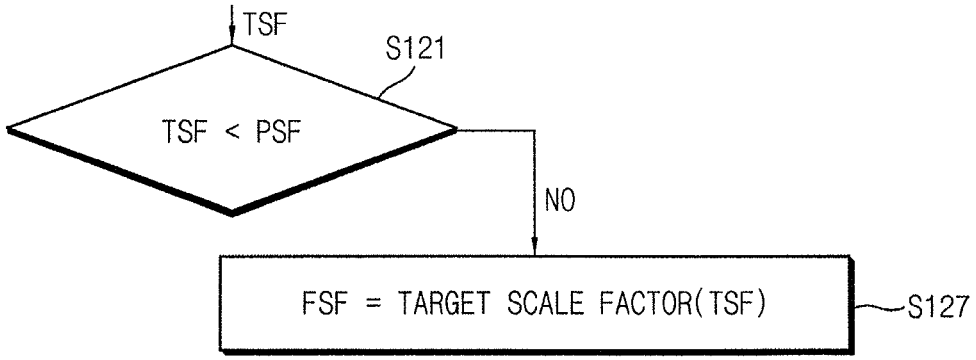
FIG. 15 illustrates an embodiment of a method for controlling scale factor when a target scale factor is greater than a previous scale factor.
Figure 16:
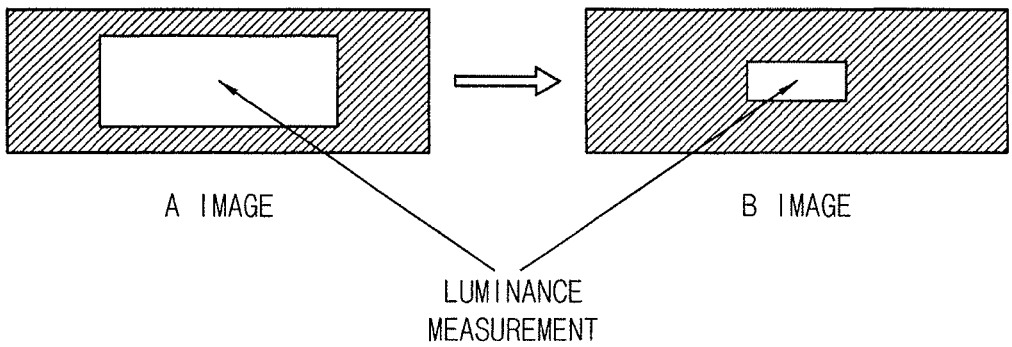
FIGS. 16 to 18 illustrate examples relating to the method of FIG. 15.
Figure 17:
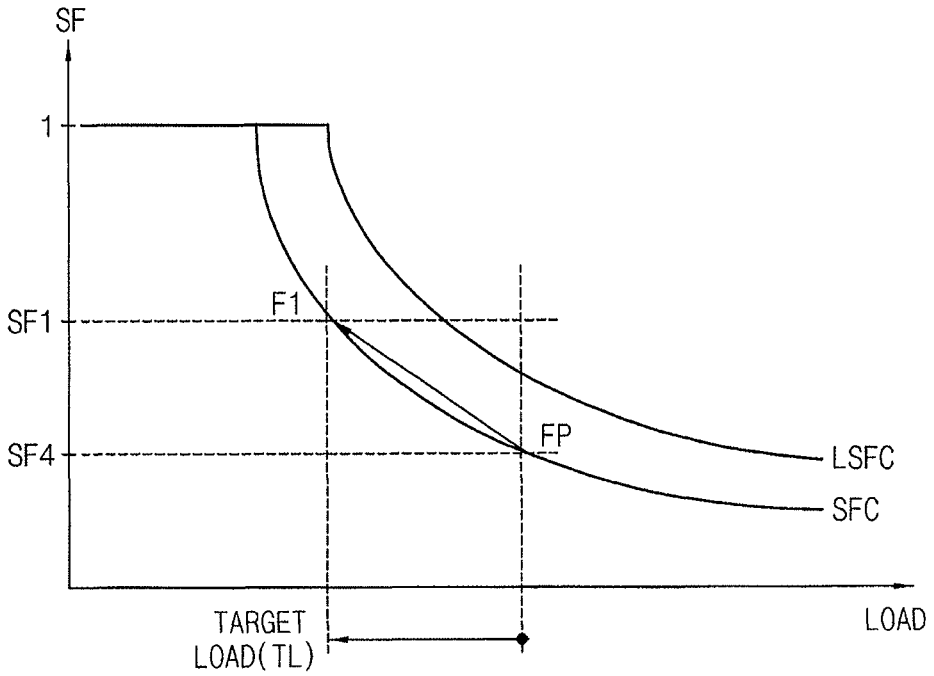
Figure 18:
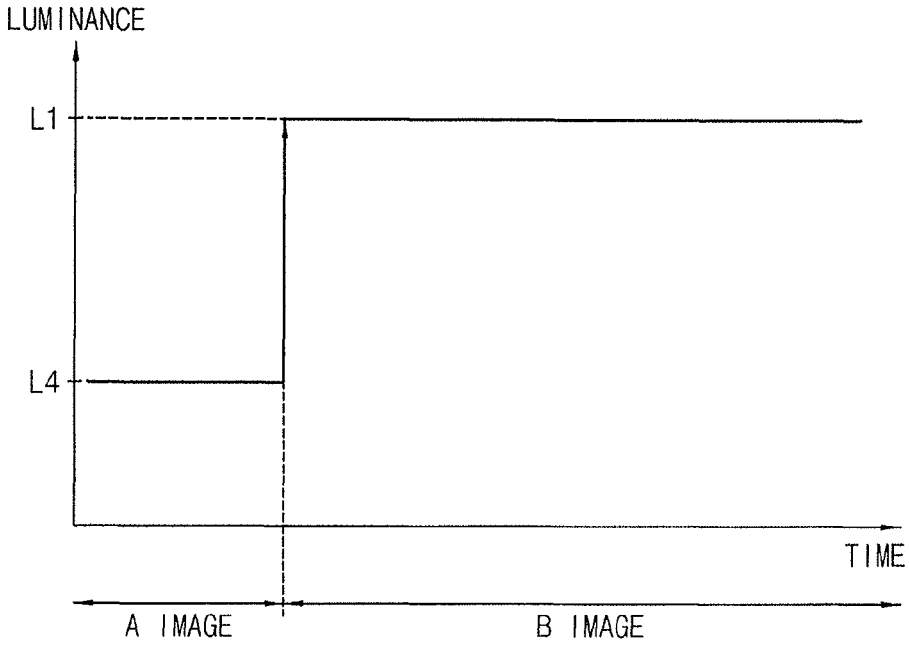

FIG. 15 illustrates another embodiment of a method for controlling the scale factor of FIG. 1, when a target scale factor is greater than a previous scale factor. FIGS. 16 to 18 illustrate examples relating to the method of FIG. 15.

Referring to FIGS. 15 to 18, when the target scale factor TSF is greater than a previous scale factor PSF provided before the target scale factor TSF, the time filter 500 provides the target scale factor TSF as the scale factor SF. For example, the number of input data ID in one frame may be 100. The accumulation input data in A-image may be 3000. The accumulation input data in B-image may be 1000. When the display panel displays the B-image after displaying the A-image, the accumulation input data may be decreased from 3000 to 1000. In this case, the target scale factor TSF may be greater than a previous scale factor PSF provided before the target scale factor TSF.

When the target scale factor TSF is greater than a previous scale factor PSF provided before the target scale factor TSF, the time filter 500 provides the target scale factor TSF as the scale factor SF. For example, the previous scale factor PSF may be the fourth scale factor SF4. The target scale factor TSF may be the first scale factor SF1. The time filter 500 may provide the fourth scale factor SF4 as the scale factor SF in the previous frame FP.

The time filter 500 may provide the first scale factor SF1 as the scale factor SF in the first frame F1 after the previous frame FP. For example, when the time filter 500 provides the fourth scale factor SF4 in the previous frame FP, the luminance of the image displayed in the display panel may be the fourth luminance L4. When the time filter 500 provides the first scale factor SF1 in the first frame F1, the luminance of the image displayed in the display panel may be the first luminance L1.

The method for controlling scale factor may decrease the power consumption by providing the scale factor SF based on the limit scale factor LSF and the moving step MS that are determined by the power consumption of the display panel.

Figure 19:
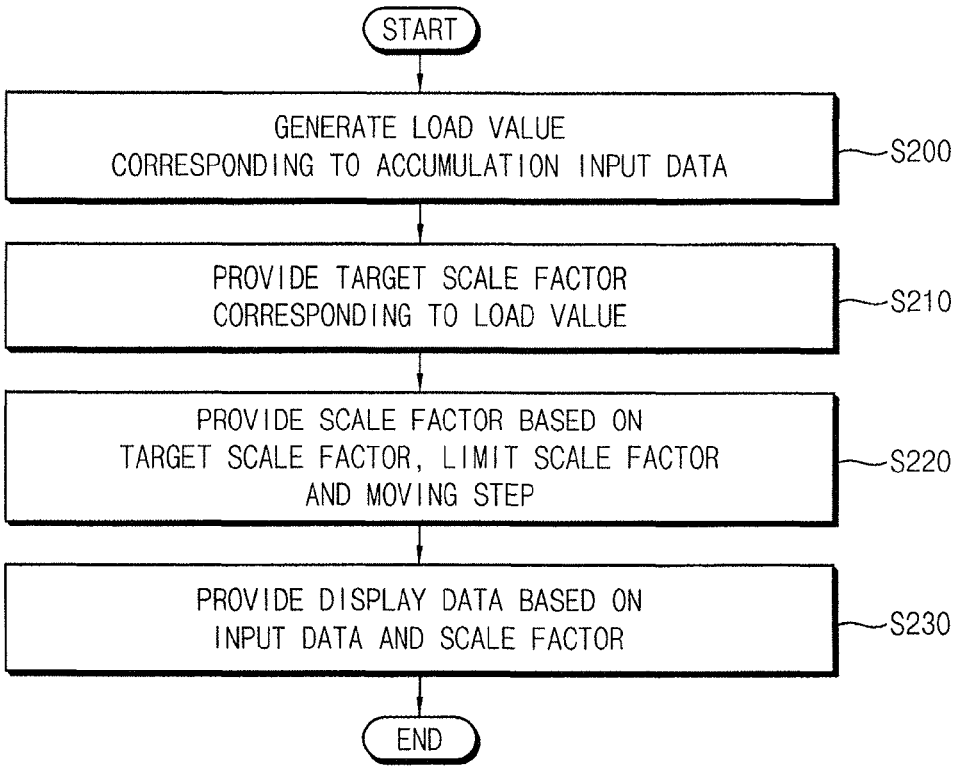
FIG. 19 illustrates an embodiment of a method for controlling luminance.
Figure 20:
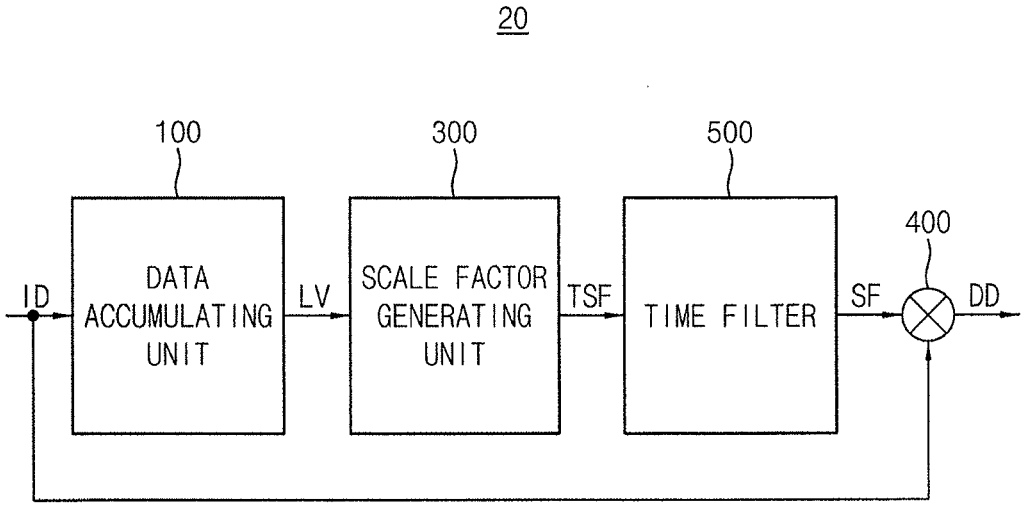
FIG. 20 illustrates an embodiment of a display data generator.

FIG. 19 illustrates an embodiment of a method for controlling luminance, and FIG. 20 illustrates an embodiment of a display data generator 20. The display data generator 20 may be used to perform the method of FIG. 19.

Referring to FIGS. 19 and 20, the display data generator 20 includes a data accumulating unit 100, a scale factor generating unit 300, a time filter 500, and display data providing unit 400. In implementing the method, the data accumulating unit 100 generates a load value LV corresponding to an accumulation input data by accumulating input data ID (S200). The accumulation input data may be a sum of the input data ID in one frame. The load value LV may be an average value of the accumulation input data. For example, the number of input data ID in one frame may be 100. The accumulation input data that is the sum of the input data ID may be 1000. In his case, the load value LV may be 10, e.g., the load value LV is generated by dividing 1000 by 100.

The scale factor generating unit 300 provides a target scale factor TSF corresponding to the load value LV (S210). When the load value LV is increased, the power consumption of the display panel may be decreased by multiplying the input data ID and the scale factor SF. For example, the number of input data ID in one frame may be 100. The accumulation input data that is the sum of the input data ID may be increased from 1000 to 3000. In this case, the load value LV may be increased from 10 to 30. When the load value LV is increased from 10 to 30, power consumption of the display panel may be increased. In this case, power consumption of the display panel may be decreased using scale factor SF.

The time filter 500 provides a scale factor SF based on the target scale factor TSF, a limit scale factor LSF, and a moving step MS (S220). The limit scale factor LSF and the moving step MS are determined by power consumption of a display panel. The limit power consumption of the display panel may be predetermined. The limit scale factor LSF may be determined in a range of the limit power consumption of the display device. The scale factor SF for the previous frame FP may be a previous scale factor PSF. The scale factor SF to be finally reached may be the target scale factor TSF.

The time filter 500 may gradually provide the scale factor SF from the previous scale factor PSF to the target scale factor TSF. For example, the target scale factor TSF may be a fourth scale factor SF4. In this case, the time filter 500 may gradually provide the scale factor SF every frame. For example, the time filter 500 may provide a first scale factor SF1 in a first frame F1. The time filter 500 may provide a second scale factor SF2 in a second frame F2. The time filter 500 may provide a third scale factor SF3 in a third frame F3. The time filter 500 may provide a fourth scale factor SF4 in a fourth frame F4. When the time filter 500 gradually provides the scale factor SF from the previous scale factor PSF to the target scale factor TSF, the image may be naturally displayed in the display panel.

In this case, the moving step MS may be, for example, an interval between the first scale factor SF1 and the second scale factor SF2. The moving step MS may be an interval between the second scale factor SF2 and the third scale factor SF3. The moving step MS may be an interval between the third scale factor SF3 and the fourth scale factor SF4. In addition, the interval between the first scale factor SF1 and the second scale factor SF2 may be equal to the interval between the second scale factor SF2 and the third scale factor SF3. The interval between the second scale factor SF2 and the third scale factor SF3 may be equal to the interval between the third scale factor SF3 and the fourth scale factor SF4. The moving step MS may be predetermined before the time filter 500 is operated.

The display data providing unit 400 provides a display data DD based on the input data ID and the scale factor SF (S230). For example, the display data providing unit 400 may provide display data DD by multiplying the input data ID and the scale factor SF.

For example, when the target scale factor TSF is less than a previous scale factor PSF provided before the target scale factor TSF and the previous scale factor PSF is greater than the limit scale factor LSF, the time filter 500 provides the limit scale factor LSF corresponding to the target scale factor TSF as the scale factor SF. The method for controlling scale factor may decrease the power consumption by providing the scale factor SF based on the limit scale factor LSF and the moving step MS that are determined by the power consumption of the display panel.

Figure 21:
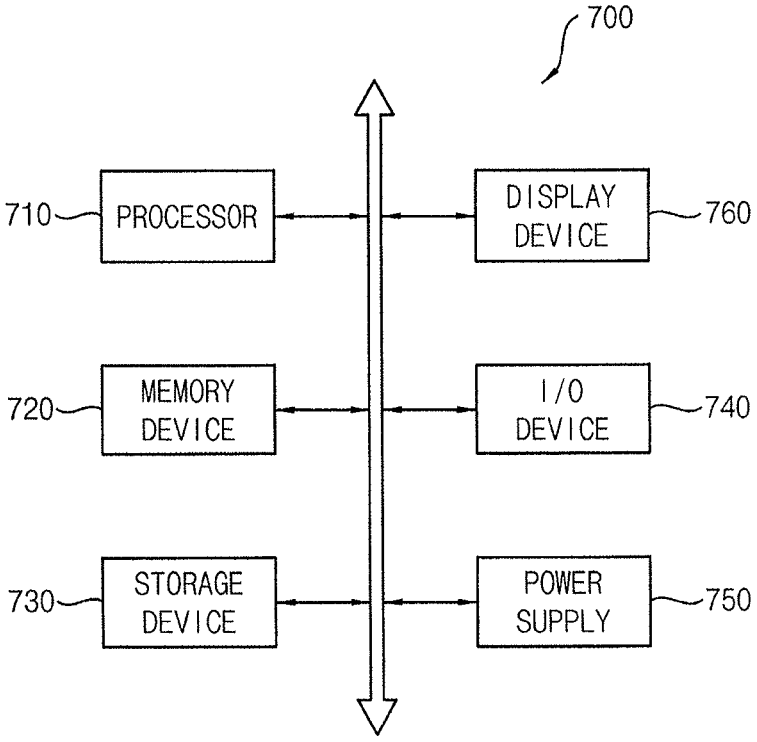
FIG. 21 illustrates an embodiment of a mobile device.

FIG. 21 illustrates an embodiment of a mobile device 700 which includes a processor 710, a memory device 720, a storage device 730, an input/output (I/O) device 740, a power supply 750, and an electroluminescent display device 760. The mobile device 700 may further include a plurality of ports for communicating a video card, a sound card, a memory card, a universal serial bus (USB) device, or other electronic systems.

The processor 710 may perform various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The electroluminescent display device 760 may communicate with other components via the buses or other communication links.

The present embodiments may be applied to any type of mobile device or computing device. For example, the present embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

The accumulating unit, scale factor generating unit, time filter, and other control and processing features of the embodiments described herein may be implemented in logic which, for example, may include hardware, software, or both. When implemented at least partially in hardware, the accumulating unit, scale factor generating unit, time filter, and other control and processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the accumulating unit, scale factor generating unit, time filter, and other control and processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, dynamic change of a display image may not be displayed because a scale factor of a present frame depends on the scale factor of a previous frame. In accordance with one or more of the aforementioned embodiments, a method is provided for controlling scale factor based on a target scale factor, a limit scale factor, and a moving step. The limit scale factor and the moving step may be determined based on power consumption of a display panel. The method may decrease the power consumption by providing the scale factor based on the limit scale factor and the moving step, that are determined based on power consumption of the display panel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A method for controlling a scale factor and controlling luminance of a display panel, comprising:

generating a load value corresponding to an average value of accumulated input data in one frame;

providing a predetermined target scale factor corresponding to the load value; and applying a scale factor to the input data based on the predetermined target scale factor, a predetermined limit scale factor, and a predetermined moving step; and when the predetermined target scale factor is less than a previous scale factor provided before the target scale factor, comparing the predetermined limit scale factor corresponding to the predetermined target scale factor to the previous scale factor, wherein the predetermined target scale factor, predetermined limit scale factor, and scale factor are scale factors of image data, wherein the scale factor adjusts a scale of image data corresponding to the input data, and wherein the predetermined limit scale factor and the predetermined moving step are determined based on power consumption of an electroluminescent display panel.

2. The method as claimed in claim 1, further comprising:

when the previous scale factor is greater than the predetermined limit scale factor corresponding to the predetermined target scale factor, providing the predetermined limit scale factor corresponding to the predetermined target scale factor as the scale factor.

3. The method as claimed in claim 2, further comprising: providing the scale factor in each of a plurality of frames.

4. The method as claimed in claim 3, further comprising:

when the predetermined limit scale factor corresponding to the predetermined target scale factor is provided as a first scale factor in a first frame, providing a second scale factor in a second frame, wherein the second scale factor is less than the limit scale factor corresponding to the predetermined target scale factor by the predetermined moving step.

5. The method as claimed in claim 4, further comprising:

when the second scale factor is provided in the second frame, providing a third scale factor in a third frame after the second frame, wherein the third scale factor is less than the second scale factor by the predetermined moving step.

6. The method as claimed in claim 5, further comprising:

decreasing the scale factor until a difference between the scale factor and the target scale factor is less than the predetermined moving step.

7. The method as claimed in claim 6, wherein luminance of a displayed image is based on the scale factor.

8. The method as claimed in claim 1, further comprising:

when the predetermined target scale factor is less than a previous scale factor provided before the predetermined target scale factor, providing the predetermined target scale factor as the scale factor.

9. The method as claimed in claim 1, further comprising:

controlling the predetermined moving step based on a step control signal.

10. The method as claimed in claim 1, further comprising:

controlling the predetermined limit scale factor based on a scale control signal.

11. The method as claimed in claim 1, further comprising:

when the previous scale factor is less than the predetermined limit scale factor corresponding to the predetermined target scale factor, providing the previous scale factor as the scale factor.

12. The method as claimed in claim 1, further comprising:

when the previous scale factor is less than the predetermined limit scale factor corresponding to the predetermined target scale factor, providing the scale factor that is less than the previous scale factor by the predetermined moving step.

13. The method as claimed in claim 12, further comprising: providing the scale factor in each of a plurality of frames.

14. The method as claimed in claim 13, further comprising:

when a first scale factor less than the previous scale factor by the predetermined moving step is provided in a first frame, providing a second scale factor less than the first scale factor by the predetermined moving step in a second frame.

15. The method as claimed in claim 14, further comprising:

decreasing the scale factor until a difference between the scale factor and the predetermined target scale factor is less than the predetermined moving step.

16. The method as claimed in claim 1, further comprising:

when the previous scale factor is equal to the predetermined limit scale factor corresponding to the predetermined target scale factor, providing the predetermined limit scale factor corresponding to the predetermined target scale factor as the scale factor.

17. The method as claimed in claim 1, further comprising:

when the predetermined target scale factor is greater than a previous scale factor provided before the predetermined target scale factor, providing the predetermined target scale factor as the scale factor.

18. A method for controlling luminance of a display panel, comprising:

generating a load value corresponding to an average value of accumulated input data in one frame;

providing a predetermined target scale factor corresponding to the load value;

applying a scale factor to the input data based on the predetermined target scale factor, a predetermined limit scale factor, and a predetermined moving step, the predetermined limit scale factor and the predetermined moving step determined based on power consumption of an electroluminescent display panel; and providing display data based on the input data and the scale factor, when the predetermined target scale factor is less than a previous scale factor provided before the predetermined target scale factor, the method includes comparing the predetermined limit scale factor corresponding to the predetermined target scale factor to the previous scale factor, wherein the predetermined target scale factor, predetermined limit scale factor, and scale factor are scale factors of image data and wherein the scale factor adjusts a scale of image data corresponding to the input data.

19. An apparatus for controlling a scale factor in a display device to control luminance of a display panel of the display device, comprising:

a data accumulator to generate a load value corresponding to an average value of accumulation input data in one frame;

a scale factor generator to provide a predetermined target scale factor corresponding to the load value; and a time filter to provide a scale factor to the input data based on the predetermined target scale factor, a predetermined limit scale factor, and a predetermined moving step; and a comparator to compare the predetermined limit scale factor corresponding to the predetermined target scale factor to a previous scale factor, when the predetermined target scale factor is less than the previous scale factor provided before the predetermined target scale factor, wherein the predetermined target scale factor, predetermined limit scale factor, and scale factor are scale factors of image data, wherein the scale factor adjusts a scale of image data corresponding to the input data, and wherein the predetermined limit scale factor and the predetermined moving step are to be determined based on power consumption of an electroluminescent display panel.

* * * * *